US006886200B2

(12) United States Patent
Blyshak et al.

(10) Patent No.: US 6,886,200 B2
(45) Date of Patent: May 3, 2005

(54) HYDRAULIC ACTUATOR APPARATUS FOR A SURGICAL TABLE

(75) Inventors: William Blyshak, Milan, IN (US); Greg Figel, Mason, OH (US); Gary S. Siegle, Cincinnati, OH (US); Jon Tekulve, Milan, IN (US); Mark Haufler, Cincinnati, OH (US); Paul Weil, Lawrenceburg, IN (US); Stephen R. Schulte, Harrison, OH (US); David C. Newkirk, Lawrenceburg, IN (US); David W. Hornbach, Brookville, IN (US); Richard L. Borders, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/056,916

(22) Filed: Jan. 25, 2002

(65) Prior Publication Data

US 2002/0144349 A1 Oct. 10, 2002

Related U.S. Application Data

(60) Provisional application No. 60/264,214, filed on Jan. 25, 2001.

(51) Int. Cl.[7] ..... A61G 13/06

(52) U.S. Cl. ..... 5/611; 5/614; 254/93 R; 92/66

(58) Field of Search ..... 92/66; 5/11, 611, 5/614; 254/93 R

(56) References Cited

U.S. PATENT DOCUMENTS

| | | | | |
|---|---|---|---|---|
| 2,217,783 A | | 10/1940 | Bell | |
| 2,483,239 A | * | 9/1949 | Sharpe | 91/167 R |
| 2,605,151 A | | 7/1952 | Shampaine | |
| 2,794,694 A | * | 6/1957 | Fullwood et al. | 5/614 |
| 2,832,656 A | | 4/1958 | Perry | |
| 2,871,085 A | | 1/1959 | Diack | |
| 2,961,837 A | | 11/1960 | Suderow | |
| 3,171,698 A | | 3/1965 | Campbell | |
| 3,206,188 A | | 9/1965 | Douglass, Jr. | |
| 3,281,141 A | | 10/1966 | Smiley et al. | |
| 3,328,093 A | | 6/1967 | Sloyan | |
| 3,362,704 A | | 1/1968 | Pilz | |
| 3,389,625 A | | 6/1968 | Wagner | |
| 3,584,864 A | | 6/1971 | Jung | |

(Continued)

FOREIGN PATENT DOCUMENTS

| | | |
|---|---|---|
| DE | 41 08 274 A1 | 10/1991 |
| DE | A 61 G 13/02 | 8/1999 |
| EP | 0 917 867 A1 | 5/1999 |
| JP | 42-11267 | 9/1960 |
| JP | 58-127648 | 7/1983 |
| WO | WO 02/058615 A2 * | 8/2002 |

OTHER PUBLICATIONS

Brochure "Linak actuators—moving toward a better work environment", 12 pgs.

*Primary Examiner*—Michael Trettel
(74) *Attorney, Agent, or Firm*—Bose McKinney & Evans LLP

(57) ABSTRACT

A patient support is provided comprising a support surface, a base, and a lift assembly positioned to support the support surface above the base. The lift assembly includes an actuator configured to adjust the height of the support surface. The actuator includes a housing formed to include first and second cylinders. The actuator further includes a first piston positioned in the first cylinder and a second piston positioned in the second cylinder. The first piston includes a first fluid passage therein. The second piston includes a second fluid passage therein.

80 Claims, 14 Drawing Sheets

U.S. PATENT DOCUMENTS 3,588,500 A 6/1971 Koerner
3,609,974 A 10/1971 Lado
3,719,403 A 3/1973 Sung
3,772,966 A * 11/1973 Mills ..... 92/66
3,837,635 A * 9/1974 Long et al. ..... 5/616
3,845,947 A 11/1974 Lee
3,851,870 A 12/1974 Cook
3,866,899 A 2/1975 Lee
3,868,103 A 2/1975 Pageot et al.
3,977,664 A 8/1976 Mitchell et al.
3,980,288 A 9/1976 Mitchell et al.
4,013,019 A 3/1977 Horsey
4,061,324 A 12/1977 Kvaerna et al.
4,098,172 A 7/1978 Wright et al.
4,195,829 A 4/1980 Reser
4,262,881 A 4/1981 Gray
4,300,782 A 11/1981 Pioth
4,327,596 A 5/1982 Simon
4,516,805 A 5/1985 Leeper et al.
4,567,894 A 2/1986 Bergman
4,589,642 A 5/1986 Schnelle et al.
4,616,813 A 10/1986 McConnell
4,686,889 A 8/1987 Hall
4,700,938 A 10/1987 Chambron
4,769,584 A 9/1988 Irigoyen et al.
4,773,637 A 9/1988 Jarin
4,912,787 A 4/1990 Bradcovich
4,956,592 A 9/1990 Schulte et al.
4,969,387 A * 11/1990 Foster ..... 91/176
4,989,848 A 2/1991 Monroe
5,053,636 A 10/1991 Zelina
5,072,588 A * 12/1991 Lowder et al. ..... 60/571
5,133,741 A 7/1992 Filho
5,208,928 A 5/1993 Kuck et al.
5,220,698 A 6/1993 Hannant
5,237,916 A 8/1993 Malashenko
5,341,725 A * 8/1994 Dick ..... 92/66
5,469,588 A 11/1995 DiMatteo et al.
5,490,297 A 2/1996 Bradcovich et al.
5,528,782 A 6/1996 Pfeuffer et al.
5,609,091 A 3/1997 Stoll
5,615,598 A 4/1997 Noroy et al.
5,621,933 A * 4/1997 Knapp et al. ..... 5/608
5,651,150 A 7/1997 Kanitzer et al.
5,659,909 A 8/1997 Pfeuffer et al.
5,704,081 A 1/1998 Bollinger
5,774,915 A 7/1998 Scott et al.
5,782,870 A 7/1998 McAfee
5,791,233 A 8/1998 Knapp et al.
5,926,002 A 7/1999 Cavanaugh et al.
6,038,718 A 3/2000 Pennington et al.
6,240,582 B1 6/2001 Reinke

* cited by examiner

HYDRAULIC ACTUATOR APPARATUS FOR A SURGICAL TABLE

This application claims benefit of U.S. Provisional Application Ser. No. 60/264,214, filed Jan. 25, 2001, titled Hydraulic Actuator Apparatus, the disclosure of which is expressly incorporated by reference herein.

BACKGROUND AND SUMMARY OF THE INVENTION

The present invention relates to surgical tables that employ actuators. More particularly, the present invention relates to hydraulic actuators used to raise and lower surgical table tops.

According to a first embodiment a patient support is provided comprising a support surface, a base, and a lift assembly positioned to support the support surface above the base. The lift assembly includes an actuator configured to adjust the height of the support surface and the actuator includes a housing. The housing is formed to include first and second cylinders, a first piston positioned in the first cylinder, and a second piston positioned in the second cylinder. The first piston includes a first piston head and a first piston rod coupled to the first piston head. The first piston rod includes a first fluid passage therein. The second piston includes a second piston head and a second piston rod coupled to the second piston head. The second piston rod includes a second fluid passage therein.

According to another embodiment of the present invention, a patient support is provided comprising a base, a support surface, and a lift assembly. The lift assembly includes a plurality of telescoping support tubes defining an interior region, and an actuator located in the interior region of the plurality of telescoping support tubes. The actuator includes a plurality of pistons, the pistons having fluid lines positioned therein.

According to another embodiment of the present invention, a patient support is provided comprising a base, a support surface, and a lift assembly. The lift assembly includes a plurality of telescoping support tubes and an actuator positioned in the plurality of telescoping support tubes. The support tubes and the actuator define an interior region therebetween. The interior region is devoid of fluid lines.

According to another embodiment of the present invention, a patient support is provided comprising a support surface, a base, a lift assembly positioned between the support surface and the base to raise and lower the support surface relative to the base, and a plurality of telescoping support tubes. The support tubes include support members and shock absorbers configured to dampen impact between the telescoping support members.

According to another embodiment of the present invention an actuator is provided comprising a housing formed to include first and second cylinders, a first piston positioned in the first cylinder, and a second piston positioned in the second cylinder. The first piston includes a first piston head and a first piston rod coupled to the first piston head, the first piston rod being formed to include a first fluid passage therein. The second piston includes a second piston head and a second piston rod coupled to the second piston head, the second piston rod being formed to include a second fluid passage therein.

According to another embodiment of the present invention an actuator is provided comprising a housing, a first piston positioned in the housing, a second piston positioned in the housing, and a fluid system coupled to the first and second pistons to supply pressurized fluid to the housing.

According to another embodiment of the present invention an actuator is provided comprising a housing, a first piston positioned in the housing, a second piston positioned in the housing, and means for providing pressurized fluid to the housing, the pressurized fluid providing means including fluid passages in the pistons.

According to another embodiment of the present invention an actuator is provided comprising a housing, a first piston positioned in the housing, a second piston positioned in the housing, a first fluid passage positioned in the first piston, a second fluid passage positioned in the second piston, and a fluid system coupled to the first and second passages to provide pressurized fluid thereto to retract and extend the first and second pistons.

Additional features of the disclosure will become apparent to those skilled in the art upon consideration of the following detailed description when taken in conjunction with the accompanying drawings.

BRIEF DESCRIPTION OF THE DRAWINGS

A detailed description particularly refers to the accompanying figures in which.

DETAILED DESCRIPTION OF THE DRAWINGS

Figure 1:
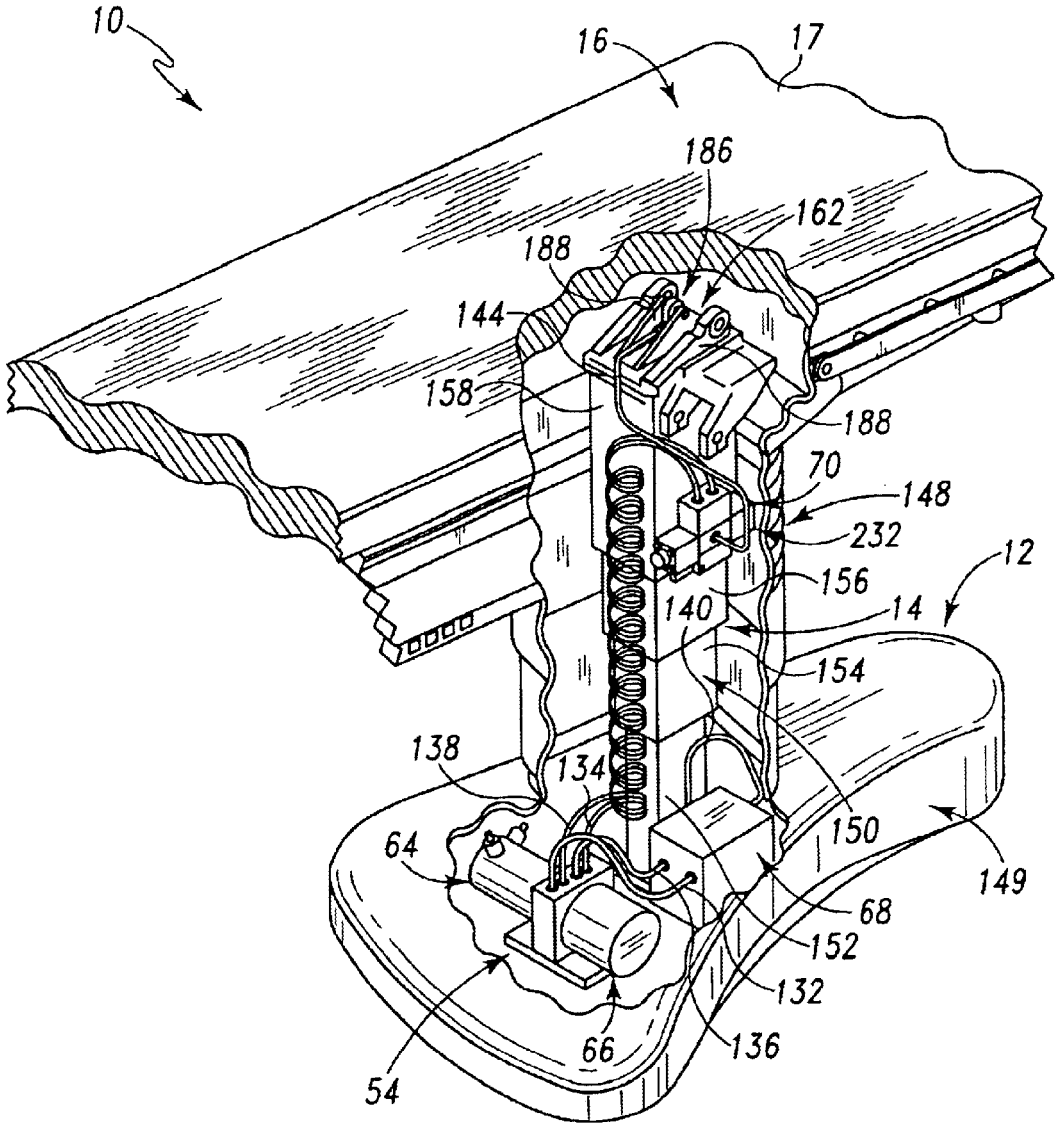
FIG. 1 is a perspective view of a preferred embodiment surgical table, with portions broken away, showing the surgical table including a base, a telescoping shroud positioned over the base, a table top positioned over the telescoping shroud, and a telescoping lift assembly positioned within an interior region of the telescoping shroud and supporting the table top on the base so that the table top can be raised and lowered relative to the base.

A surgical table or patient support 10 in accordance with a preferred embodiment of the present disclosure is shown in FIG. 1. Table 10 includes a base 12, a telescoping lift assembly 14 positioned on base 12, and a surgical table top 16 supported by telescoping lift assembly 14 and defining a patient rest surface 17. Telescoping lift assembly 14 is configured to raise and lower table top 16 so that a surgeon or other care provider can raise or lower a patient positioned on table top 16 to a desired level for performing a surgical or other medical procedure. Additional disclosure of a suitable table top is disclosed in U.S. patent application Ser. No. 09/187,990 to Richard L. Borders, titled Surgical Table Apparatus, filed Nov. 6, 1998, U.S. Provisional Patent Application Ser. No. 60/064,709, filed Nov. 7, 1997, U.S. Provisional Patent Application Ser. No. 60/083,673, filed Apr. 30, 1998, U.S. Provisional Patent Application Ser. No. 60/300,625, filed Jun. 6, 2001, and U.S. Provisional Patent Application Ser. No. 60/326,866, filed Oct. 3, 2001 the disclosures of which are expressly incorporated by reference herein.

Figure 2:
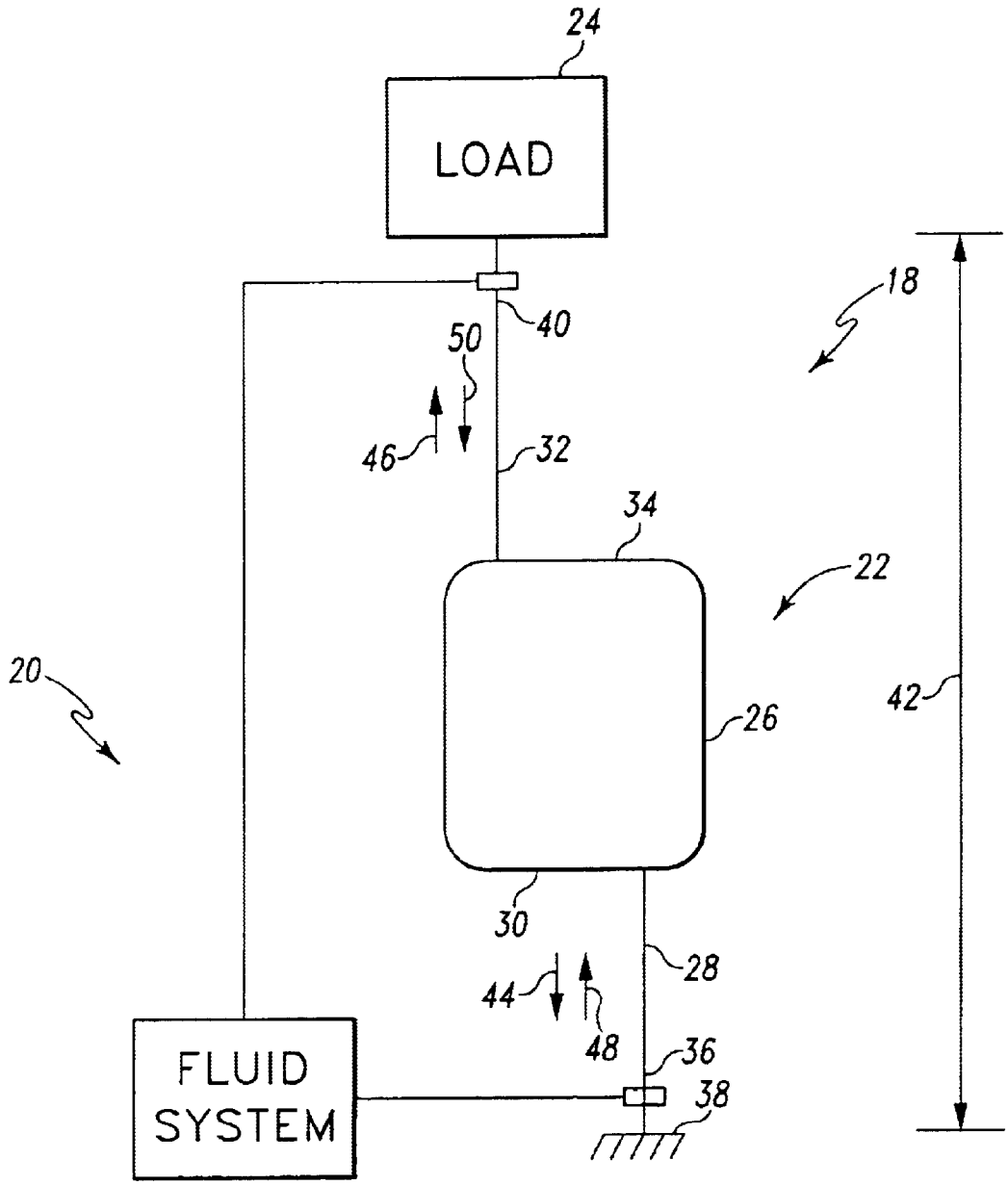
FIG. 2 is a diagrammatic view of a fluid power actuator system suitable for use with the telescoping lift assembly of FIG. 1 showing the fluid power actuator system including a fluid system and an actuator apparatus coupled to a load, the actuator apparatus including a housing, a first actuation rod extending from the housing and coupled to ground, and a second actuation rod extending from the housing and coupled to the load, and the fluid system being coupled to the first and second actuation rods.

In FIGS. 1, 3, 13, and 14, telescoping lift assembly 14 is shown as a component of surgical table 10 that raises and lower table top 16. However according to the present disclosure, telescoping lift assembly 14 and its individual components may be used in other applications. For example, FIG. 2 is a diagrammatic view of a fluid power actuator system 18 suitable for use with telescoping lift assembly 14 or any other device that requires movement of an item.

Fluid power actuator system 18 includes a fluid system 20 and an actuator apparatus 22 coupled to a load 24, such as table top 16, a component of a piece of manufacturing equipment, a linkage, or any other item that requires movement. Actuator apparatus 22 includes a housing 26, a first actuation rod 28 extending from a lower end 30 of housing 26 and a second actuation rod 32 extending from an upper end 34 of housing 26. A lower end 36 of first actuation rod 28 is coupled to fluid system 20 and an upper end (not shown) is positioned within housing 26. Lower end 36 is also coupled to ground or base 38 to provide support to the remainder of actuator apparatus 22. An upper end 40 of second actuation rod 32 is coupled to fluid system 20 and a lower end (not shown) is positioned within housing 26. Upper end 40 is also coupled to load 24 to provide support thereto.

First and second actuation rods 28, 32 are configured to move relative to housing 26 between extended and retracted positions so that an overall length 42 of actuator apparatus 22 can be adjusted to raise and lower load 24. For example, to raise load 24, first and second actuation rods 28, 32 are moved in respective directions 44, 46 away from housing 26 so that more of rods 28, 32 are exposed and less of rods 28, 32 are positioned in housing 26. To lower load 24, first and second actuation rods 28, 32 are moved in respective directions 48, 50 toward housing 26 so that less of rods 28, 32 are exposed and more of rods 28, 32 are positioned in housing 26.

Fluid system 20 provides the power and control for moving first and second actuation rods 28, 32 relative to housing 26. First and second actuation rods 28, 32 each include fluid passages (not shown) therein. The fluid passage of first actuation rod 28 extends from lower end 36, where first actuation rod 28 is coupled to fluid system 20, to a portion of first actuation rod 28 positioned in housing 26. The fluid passage of second actuation rod 32 extends from upper end 40, where it is coupled to fluid system 20, to a portion of second actuation rod 32 positioned in housing 26.

To raise load 24, fluid system 20 pumps fluid into housing 26 through first actuation rod 28 and withdraws fluid from housing 26 through second actuation rod 32. To lower load 24, fluid system 20 pumps fluid into housing 26 through second actuation rod 32 and withdraws fluid from housing 26 through first actuation rod 28. To maintain the height of load 24, fluid system 20 prevents fluid from entering or leaving housing 26. According to an alternative embodiment of the present disclosure, each fluid passage is positioned in one of the actuation rods so that the fluid system is coupled to only one of the actuation rods. Thus, an apparatus is provided for moving an item with a pair of actuation rods having internal fluid passages in the actuation rod(s) so that fewer or no external fluid supply lines coupled to the housing are necessary.

Figure 3:
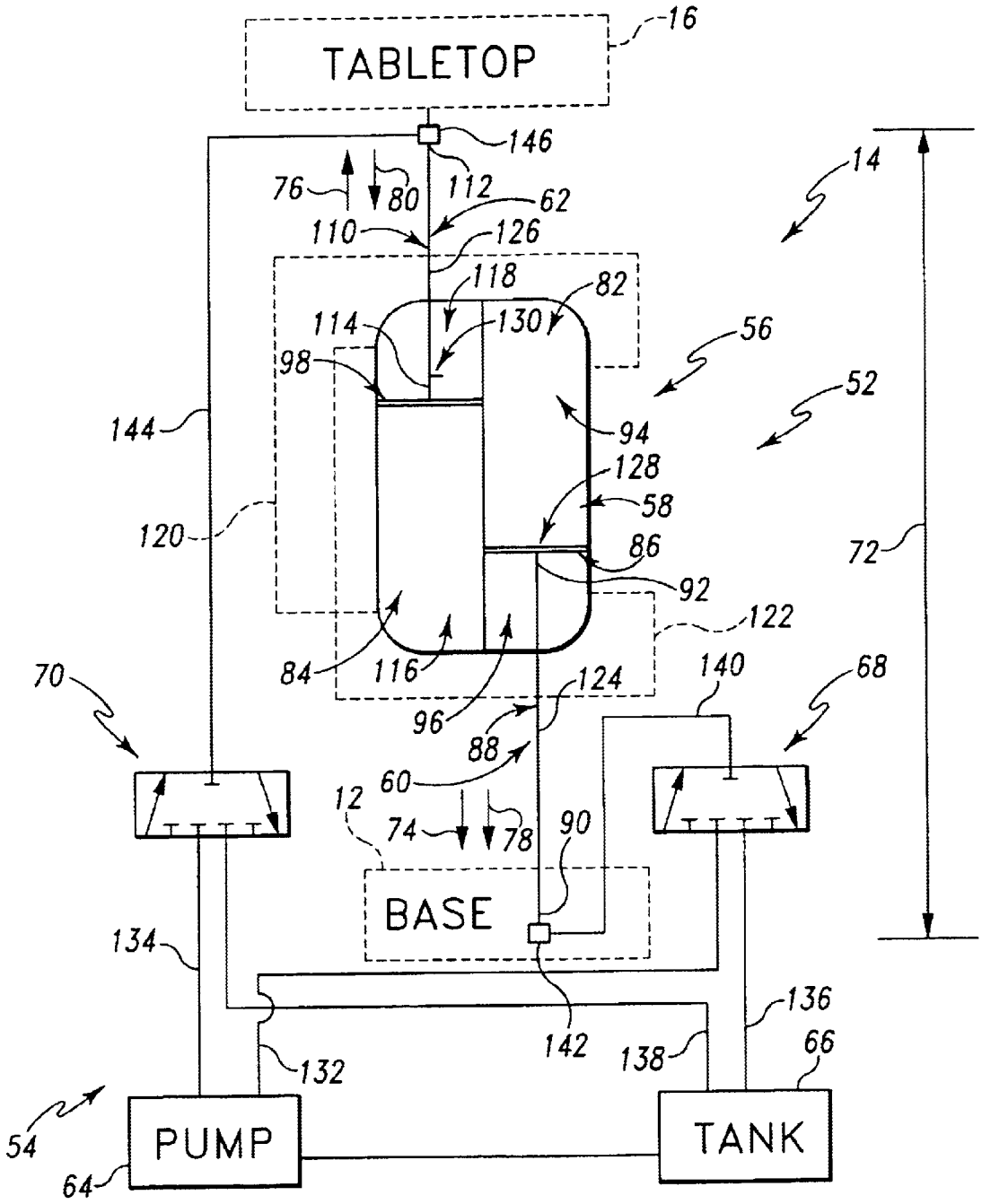
FIG. 3 is a diagrammatic view of a preferred embodiment hydraulic actuator system including in the telescoping lift assembly of FIG. 1 showing the hydraulic actuator system including a fluid system and an actuator apparatus supporting a surgical table top, the actuator apparatus including a housing, a first piston rod extending from the housing and coupled to a surgical table base, a second piston extending from the housing and coupled to the table top, the fluid system including a pump, a tank, a first three-position valve coupling the pump and tank to the first piston, and a second three-position valve coupling the pump and tank to the second piston.
Figure 6:
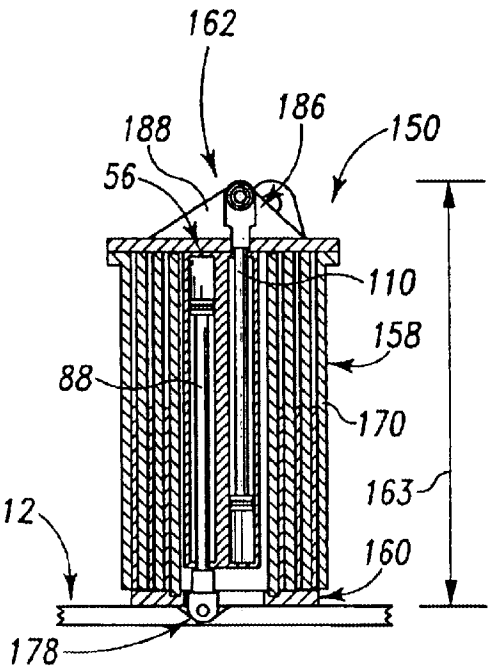
FIG. 6 is a cross-sectional view similar to FIG. 4 showing the bi-directional hydraulic actuator apparatus in a retracted position supporting the telescoping support members in a retracted position to support the table top in a lowered position.
Figure 5:
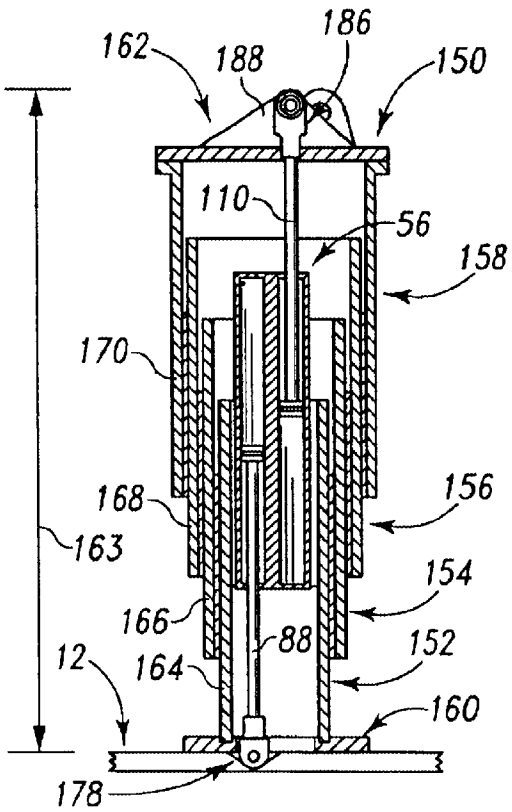
FIG. 5 is a cross-sectional view similar to FIG. 4 showing the bi-directional hydraulic actuator apparatus in an intermediate position supporting the telescoping support members in intermediate positions.
Figure 4:
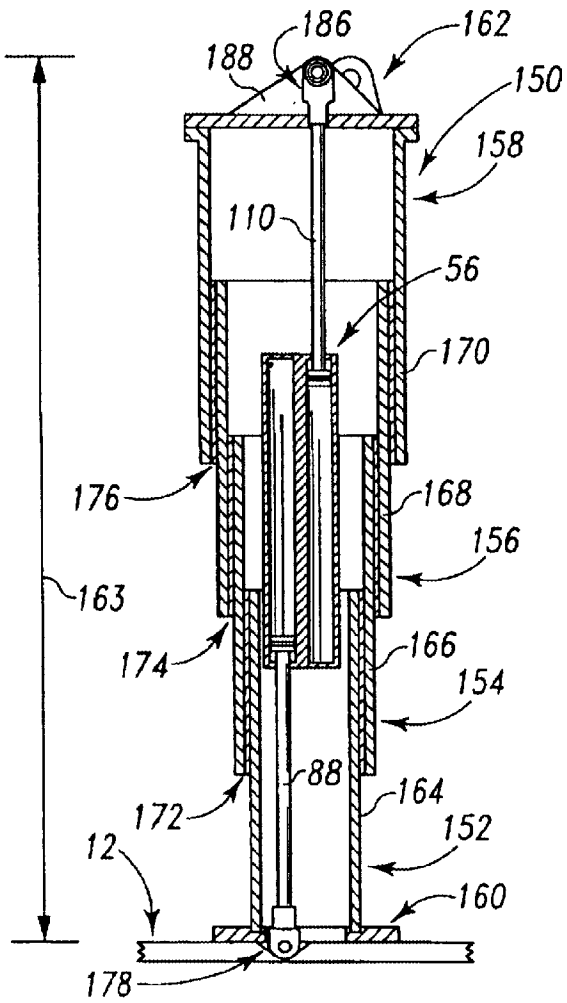
FIG. 4 is a cross-sectional view of the telescoping lift assembly of FIG. 1 showing the telescoping lift assembly including four telescoping support members and a bi-directional hydraulic actuator apparatus positioned within the telescoping support members and being in an extended position supporting the telescoping support members in an extended position to support the table top in a raised position.
Figure 7:
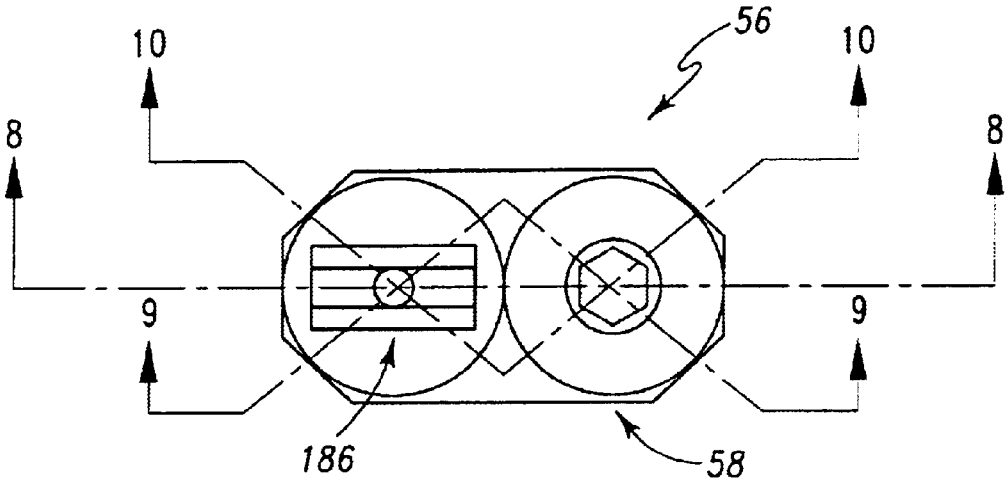
FIG. 7 is a top plan view of the bi-directional hydraulic actuator apparatus of FIG. 4.

FIG. 3 is a diagrammatic view of a preferred embodiment hydraulic actuator system 52 included in telescoping lift assembly 14 of surgical table 10. Hydraulic actuator system 52 includes a fluid system 54 and an actuator apparatus 56 supporting surgical table top 16. Actuator apparatus 56 includes a housing 58, a first piston 60 extending from housing 58, and a second piston 62 also extending from housing 58. First piston 60 is coupled to surgical table base 12 and second piston 62 is coupled to and supports table top 16. Fluid system 54 includes a pump 64, a tank 66, a first three-position valve 68 coupling pump 64 and tank 66 to first piston 60, and a second three-position valve 70 coupling pump 64 and tank 66 to second piston 62.

First and second pistons 60, 62 are configured to move relative to housing 58 between extended and retracted positions so that an overall length 72 of actuator apparatus 56 can be adjusted to raised and lower table top 16. For example, to raise table top 16, first and second pistons 60, 62 are moved in respective directions 74, 76 away from housing 58 so that more of pistons 60, 62 are exposed and less of pistons 60, 62 are positioned in housing 58. To lower table top 16, first and second actuation rods 60, 62 are moved in respective directions 78, 80 toward housing 58 so that less of pistons 60, 62 are exposed and more of pistons 60, 62 are positioned in housing 58.

Housing 58 is formed to include first and second piston cylinders 82, 84 configured to receive first and second pistons 60, 62. First piston 60 includes a first piston head 86 positioned in first piston cylinder 82 and a first piston rod 88 having a lower end 90 coupled to fluid system 54 and an upper end 92 coupled to first piston head 86. First piston head 86 divides first piston cylinder 82 into a first forward chamber 94 in front of first piston head 86 and a first rear chamber 96 behind first piston head 86. Second piston 62 includes a second piston head 98 positioned in second piston cylinder 84 and a second piston rod 110 having an upper end 112 coupled to fluid system 54 and a lower end 114 coupled to second piston head 98. Second piston head 98 divides second piston cylinder 84 into a second forward chamber 116 in front of second piston head 98 and a second rear chamber 118 behind second piston head 98. A forward chamber fluid passage 120 is provided to communicate fluid between first and second forward chambers 94, 116 and a rear chamber fluid passage 122 is provided to communicate fluid between first and second rear chambers 96, 118. According to the presently preferred embodiment, forward and rear fluid passages 120, 122 are positioned in housing 58. According to alternative embodiments, either or both of the forward and rear fluid passages are external to the housing. The fluid passages may be drilled, cast, provided by tubing, or otherwise defined by techniques or devices known to those of ordinary skill in the art.

Fluid system 54 provides the power and control for moving first and second pistons 60, 62 relative to housing 58. First and second pistons 60, 62 include respective first and second fluid passages 124, 126 extending from respective lower and upper ends 90, 112 of first and second pistons 60, 62 into respective first and second piston cylinders 82, 84 of housing 58. As shown in FIG. 3, first fluid passage 124 is formed in first piston rod 88 and first piston head 86 and has a port 128 that communicates with first forward chamber 94 of first piston cylinder 82. Second fluid passage 126 is formed in second piston rod 110 and has a port 130 that communicates with rear chamber 118 of second piston cylinder 84. According to an alternative embodiment, the first and second fluid passages are positioned in one of the first and second pistons so that the first fluid passage extends through the respective piston head into the respective forward chamber in front of said piston head and the second fluid passage terminates short of said piston head and communicates with the respective rear chamber behind said piston head.

As shown in FIG. 3, first and second three-position valves 68, 70 are configured to control the direction of fluid flow from pump 64 and tank 66 to and from actuator apparatus 56. Fluid system 54 includes a first pump line 132 extending from pump 64 to first three-position valve 68 and a second pump line 134 extending from pump 64 to second three-position valve 70. Similarly, fluid system 54 includes a first tank line 136 extending from tank 66 to first three-position valve 68 and a second tank line 138 extending from tank 66 to second three-position valve 70. Fluid system 54 also includes a first supply line 140 extending from first three-position valve 68 to a port 142 formed in lower end 90 of first piston rod 88 and a second supply line 144 extending from second three-position valve 70 to a port 146 formed in upper end 112 of second piston rod 110.

First and second three-position valves 68, 70 move through several positions to control the flow of fluid from pump 64 to actuator apparatus 56 and from actuator apparatus 56 to tank 66. Each three-position valve 68, 70 has a pump position permitting fluid to flow to actuator apparatus 56 from pump 64, a tank position permitting fluid to flow to tank 66 from actuator apparatus 56, and a block position, as shown in FIG. 3, blocking the flow of fluid to or from actuator apparatus 56. When first and second three-position valves 68, 70 are in the pump position, they are shifted to the right of the block position shown in FIG. 3. Similarly, when first and second three-position valves 68, 70 are in the tank position, they are shifted to the left of the block position shown in FIG. 3.

To raise table top 16, fluid system 54 pumps fluid into housing 58 through first piston rod 88 and removes fluid from housing 58 through second piston rod 110. To lower table top 16, fluid system 54 pumps fluid into housing 58 through second piston rod 110 and removes fluid from housing 58 through first piston rod 88.

When raising table top 16, first-three-position valve 68 is moved to the pump position so that pressurized fluid flows from pump 64 into first pump line 132, first three-position valve 68, first supply line 140, first piston rod 88, and into housing 58. Second three-position valve 70 is moved to the tank position so that fluid flows from housing 58 through second piston rod 110, second supply line 144, second three-position valve 70, second tank line 138, and into tank 66. The fluid pumped into housing 58 through first piston rod 88 is dumped into first forward chamber 94 of first piston cylinder 82 causing an increase in fluid pressure therein. This pressure creates a downward force on first piston head 86 urging first piston 60 further out of housing 58. Forward chamber fluid passage 120 communicates this pressure to second forward chamber 116 of second piston cylinder 84 causing an increase in fluid pressure therein. This pressure creates an upward force on second piston head 98 urging second piston 62 further out of housing 58. The movement of first and second pistons 60, 62 further out of housing 58 causes overall length 72 of actuator apparatus 56 to increase and table top 16 to raise.

Movement of first and second piston heads 86, 98 during raising creates pressure in first and second rear chambers 96, 118. Pressure in second rear chamber 118 is vented through second fluid passage 126 formed in second piston rod 110 to tank 66. Pressure in first rear chamber 96 is vented through rear chamber fluid passage 122 into second rear chamber 118 that is then vented through second fluid passage 126 to tank 66. By permitting fluid to vent from first and second rear chambers 96, 118 to tank 66, first and second piston heads 86, 98 are permitted to move outwardly with little internal resistance.

When lowering table top 16, second three-position valve 70 is moved to the pump position so that pressurized fluid flows from pump 64 into second pump line 134, second three-position valve 70, second supply line 144, second piston rod 110, and into housing 58. First three-position valve 68 is moved to the tank position so that fluid flows from housing 58 through first piston rod 88, first supply line 140, first three-position valve 68, first tank line 136, and into tank 66. The fluid pumped into housing 58 through second piston rod 110 is dumped into rear chamber 118 of second piston cylinder 84 causing an increase in fluid pressure therein. This pressure creates a downward force on second piston head 98 urging second piston 62 further into housing 58. Rear chamber fluid passage 122 communicates this pressure to first rear chamber 96 of first piston cylinder 82 causing an increase in fluid pressure therein. This pressure creates an upward force on first piston head 86 urging first piston 60 further into housing 58. The movement of first and second pistons 60, 62 further into housing 58 causes overall length 72 of actuator apparatus 56 to decrease and table top 16 to lower.

Movement of first and second piston heads 86, 98 during lowering creates pressure in first and second forward chambers 94, 116. Pressure in first forward chamber 94 is vented through first fluid passage 124 formed in first piston head 86 and first piston rod 88 to tank 66. Pressure in second forward chamber 116 is vented through forward chamber fluid passage 120 into first forward chamber 94 that is then vented through first fluid passage 124 to tank 66. By permitting fluid to vent from first and second forward chambers 94, 116 to tank 66, first and second piston heads 86, 98 are permitted to move inwardly with little internal resistance.

To maintain the height of table top 16, fluid system 54 prevents fluid from entering or leaving housing 58. After raising or lowering table top 16 to a required height, first and second three-position valves 68, 70 are moved back to the block position shown in FIG. 3 to prevent fluid from flowing through first and second supply lines 140, 144. Because the fluid is a substantially non-compressible oil or other fluid and movement of the fluid is blocked by first and second three-position valves 68, 70, first and second pistons 60, 62 are blocked from moving so that table top 16 is maintained at the required height. According to alternative embodiments of the present disclosure, the fluid system and/or actuator apparatus are used on other devices that require movement of an item.

Telescoping lift assembly 14 includes preferred embodiment fluid system 54 and preferred embodiment actuator apparatus 56 as shown in FIG. 3. Table 10 includes a telescoping shroud 148 and a base shroud 149 positioned to protect fluid system 54 as shown in FIG. 1. Telescoping lift assembly 14 further includes a support member set 150 having first, second, third, and fourth telescoping support members 152, 154, 156, 158, a base plate 160 rigidly coupled to base 12 and first telescoping support member 152, and a yoke 162 rigidly coupled to fourth telescoping support member 158. Table top 16 is pivotably coupled to yoke 162 to permit tilting of table top 16 relative telescoping lift assembly 14.

Support member set 150 provides lateral support for table top 16 during and after raising and lowering of table top 16 by actuator apparatus 56. As shown in FIGS. 1 and 4–6, first, second, third, and fourth telescoping support members 152, 154, 156, 158 increase in size relative to one another so that each respective support member 152, 154, 156 is telescopically received within the next respective support member 154, 156, 158. This configuration permits an overall length 163 of support member set 150 to increase or decrease as table top 16 is raised or lowered.

As shown in FIGS. 1 and 4–6, first piston rod 88 is coupled to base 12 and second piston rod 110 is coupled to yoke 162. Thus, as actuator apparatus 56 expands, second piston rod 110 pushes yoke 162 upwardly. Yoke 162 pulls fourth telescoping support member 158 upwardly. Fourth telescoping support member 158 pulls third telescoping support member 156 upwardly which pulls second telescoping support member 154 upwardly. Because first telescoping support member 152 is rigidly coupled to base plate 160, first telescoping support member 152 remains stationary during raising and lower of table top 16.

Figure 12:
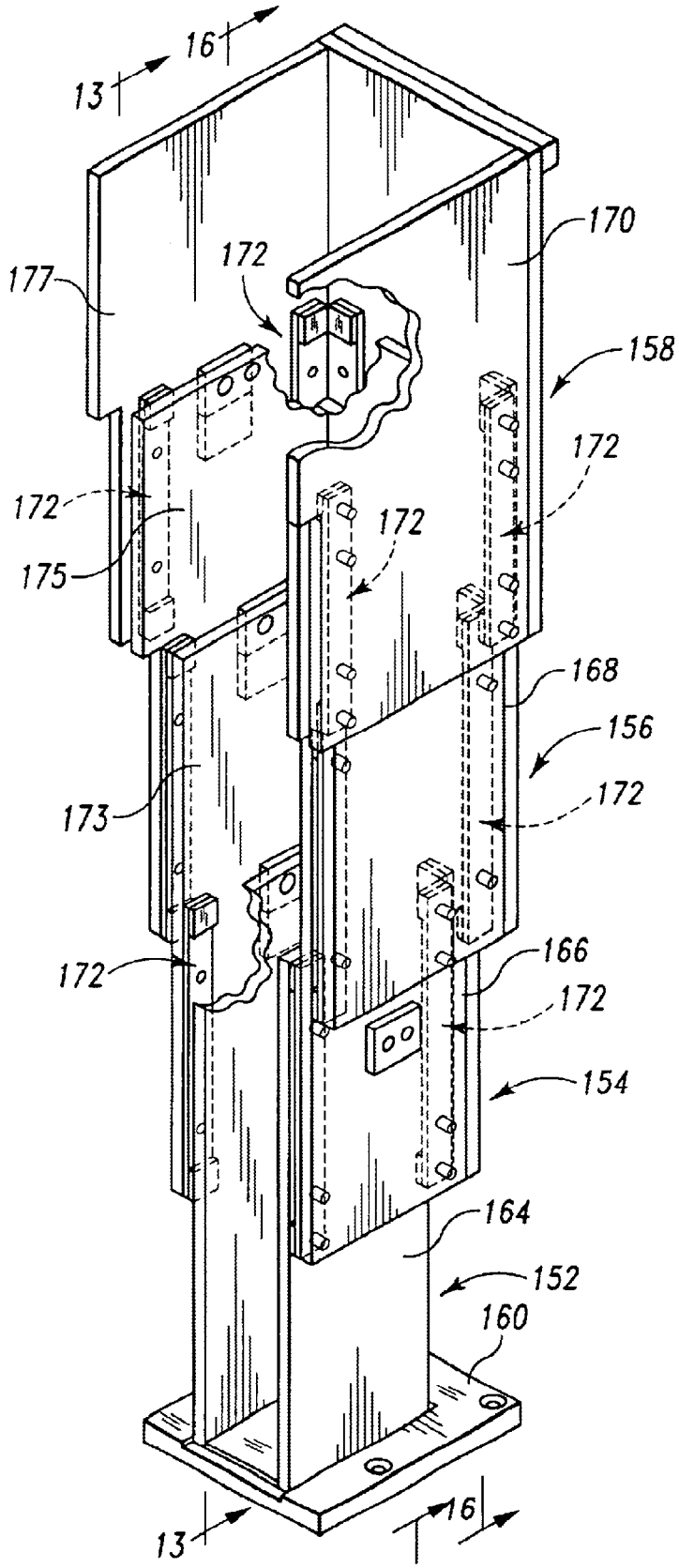
FIG. 12 is a perspective view of the telescoping lift assembly in a fully extended position, without the hydraulic actuator apparatus, showing the four telescoping support members and a plurality of elongated contact pads and interlocking blocks positioned between the telescoping support members.

Each of first, second, third, and fourth telescoping support members 152, 154, 156, 158 have a hollow rectangular perimeter wall 164, 166, 168, 170. Second, third, and fourth telescoping support members 154, 156, 158 each include a plurality of contact pads 172 coupled to inner surfaces 173, 175, 177 of respective perimeter walls 166, 168, 170. As shown in FIG. 12, two contact pads 172 are positioned at each interior corner of perimeter walls 166, 168, 170. Each of the forward most sides of perimeter walls 164, 166, 168, 170 is not shown in FIG. 12 for clarity. The forward most side is substantially identical to the rear most side of perimeter walls 164, 166, 168, 170.

Figure 15:
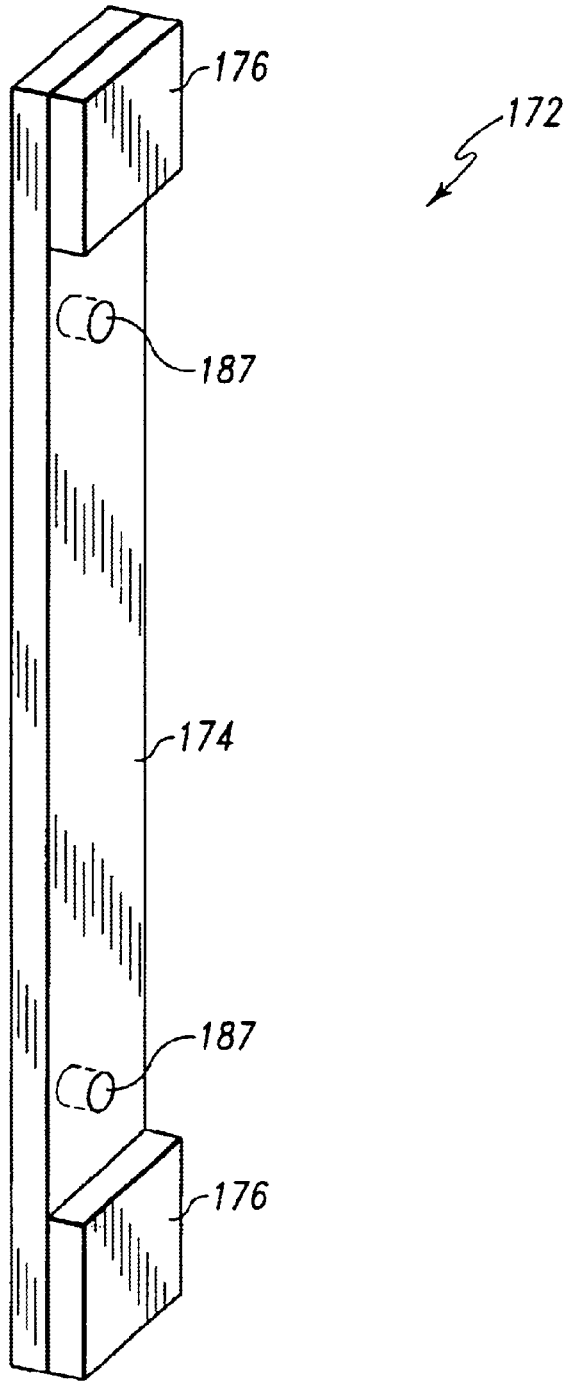
FIG. 15 is a perspective view of one of the contact pads of FIG. 12 showing the contact pad including an elongated backing strip and a pair of square-shaped wear pads coupled to the backing strip.

As shown in FIG. 15, contact pads 172 include a backing strip 174 and a pair of plastic wear pads 176 coupled to the respective backing strips 174. Wear pads 176 provide a surface on which first, second, and third support members 152, 154, 156 ride during relative movement with each other during raising and lower of table top 16. For example, wear pads 176 of third telescoping support member 156 provide a surface on which perimeter wall 168 of second telescoping support member 154 rides relative to third telescoping support member 156.

Figure 16:
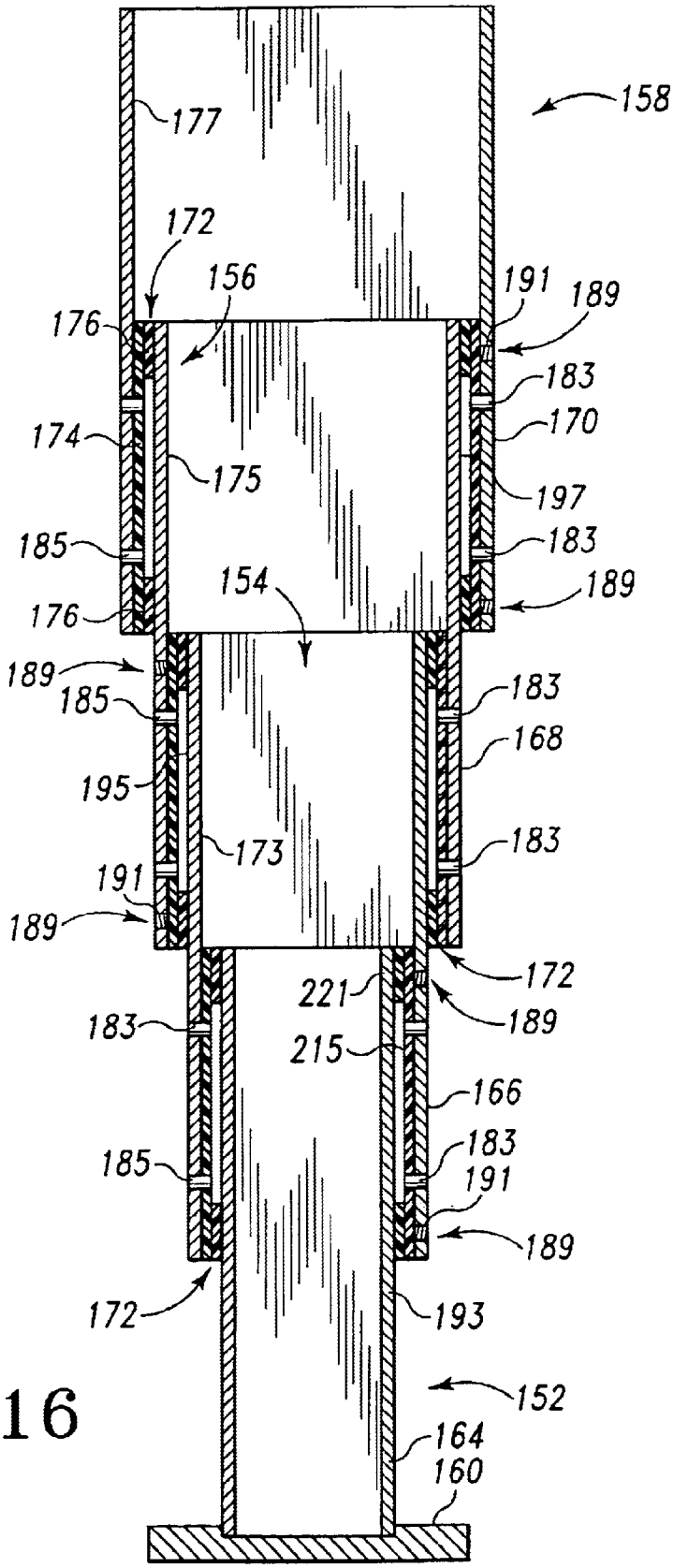
FIG. 16 is a cross-sectional view taken along line 16—16 of FIG. 12 showing the four telescoping members and contact pads positioned therebetween.

Wear pads 176 of contact pads 172 are adjustable relative to perimeter walls 166, 168, 170 to permit adjustment of the contact force between first, second, third, and fourth telescoping members 152, 154, 156, 158. As shown in FIG. 16, second, third, and fourth telescoping support members 154, 156, 158 each include a plurality of guide pins 183 positioned in apertures 185 formed in respective perimeter walls 166, 168, 170. Each backing strip 174 includes a pair of apertures 187 sized to receive respective guide pins 183 so that contact pads 172 can slide thereon Second, third, and fourth telescoping support members 154, 156, 158 include respective allen-headed adjustment screws 189 positioned in threaded apertures 191 formed in respective each respective perimeter wall 166, 168, 170 behind the respective wear pads 176 as shown in FIG. 16. To adjust the amount of contact force between wear pads 176 and the respective outer surface 193, 195, 197 of the adjacent perimeter walls 164, 166, 168, respective adjustment screws 189 are turned in threaded apertures 191. As the respective adjustment screws 189 are turned further into threaded apertures 191, respective wear pads 176 are pushed further into contact with outer surfaces 193, 195, 197. According to alternative embodiments of the present disclosure, other configurations of support member sets or other lateral supports are provided. For example, according to an alternative embodiment, a support member set having three octagonal support members is provided. According to alternative embodiments of the present disclosure, adjustment screws are provided behind each of the wear pads.

Figure 13:
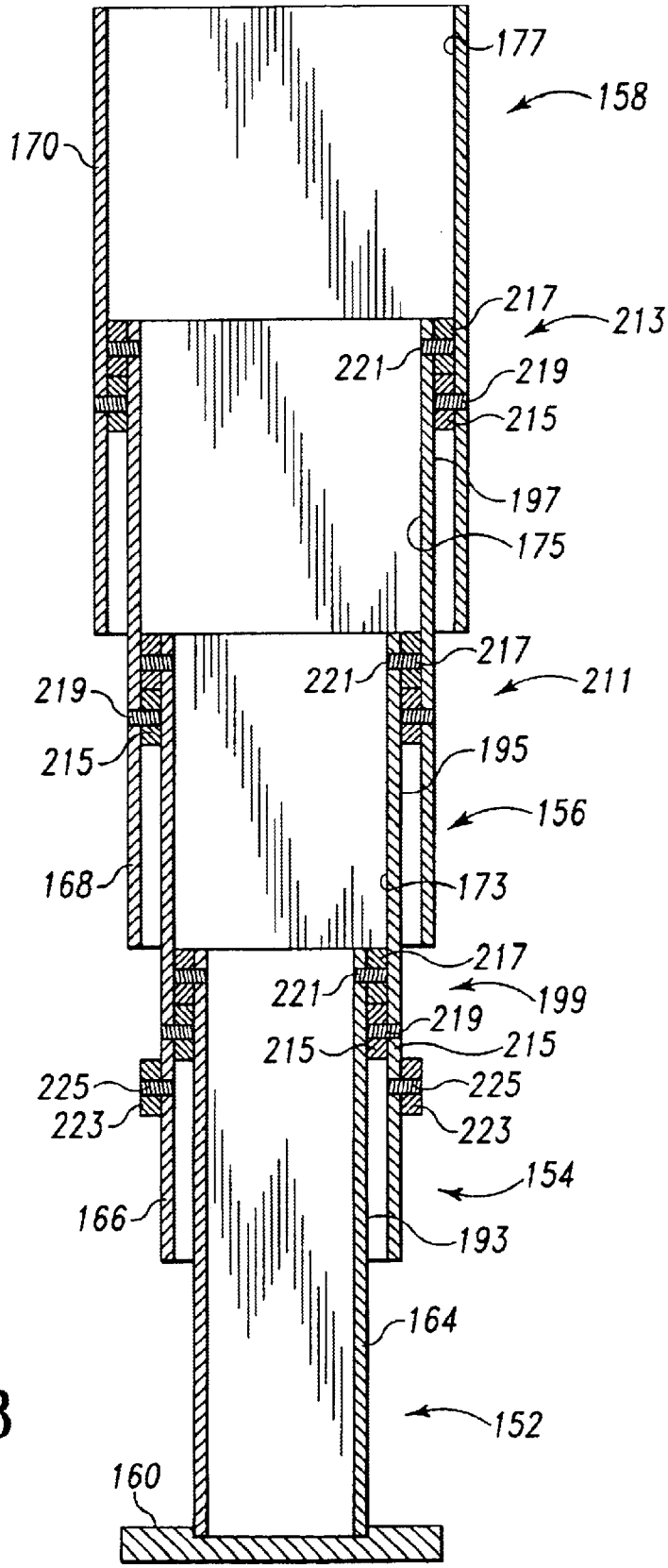
FIG. 13 is a cross-sectional view taken along line 13—13 of FIG. 12, with the contact pads not shown for clarity, showing the four telescoping members and a two pairs of interlocking blocks positioned between each of the telescoping members, an upper block of each set of interlocking blocks being coupled to an interior telescoping member, and a lower block of each set of interlocking blocks being coupled to an exterior telescoping member.
Figure 14:
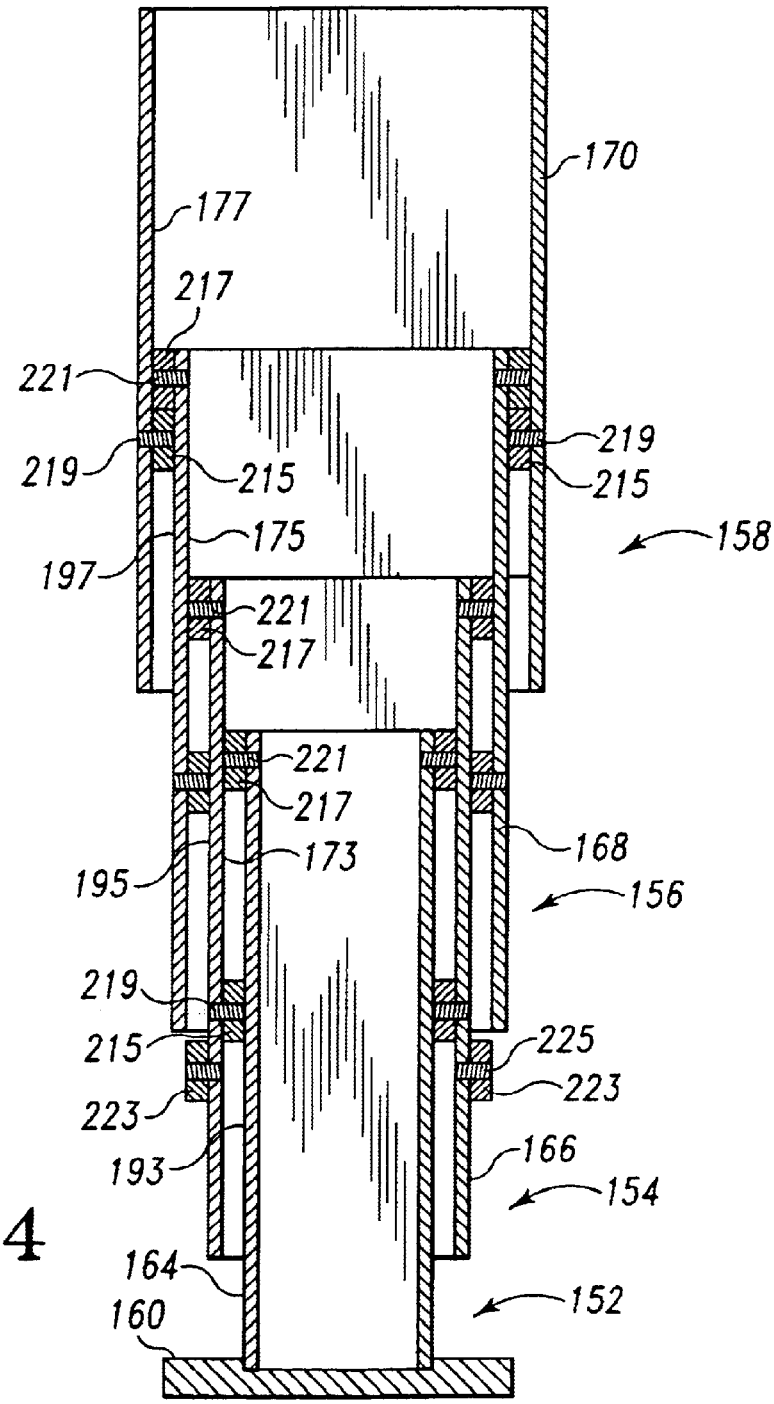
FIG. 14 is a view similar to FIG. 13 showing the four telescoping members in a position between the fully extended position shown in FIG. 13 and a fully retracted position showing a top two pairs of interlocking blocks positioned adjacent to one another, a middle two pairs of interlocking blocks positioned apart from one another, and a lower two pairs of interlocking blocks positioned apart from one another.

As shown in FIGS. 13 and 14, three interlocking sets 199, 211, 213 are provided to coordinate movement of second, third, and fourth telescoping support members 154, 156, 158 during extension of actuator apparatus 56. Each set 199, 211, 213 includes a pair of respective rectangular, plate-like lower blocks 215 coupled to opposite inner surfaces 173, 175, 177 of second, third, and fourth perimeter walls 166, 168, 170 by fasteners 219. Each set 199, 211, 213 further includes a pair of rectangular, plate-like upper blocks 217 coupled to opposite outer surfaces 193, 195, 197 of adjacent perimeter walls 164, 166, 168 by fasteners 221 in a position directly above respective lower blocks 215. Lowest set 199 further includes a pair of blocks 223 coupled to the outer surface 195 of second perimeter wall 166 by fasteners 225.

As actuator apparatus 56 extends, fourth telescoping member 158 is pushed upwardly and moves relative to third telescoping member 156 until lower blocks 215 coupled to fourth telescoping member 158 contact upper blocks 217 coupled to third telescoping member 156. Lower blocks 215 then push upper blocks 217 and third telescoping member 156 upwardly. Similarly, as actuator apparatus 56 continues to extend, third telescoping member 156 moves relative to second telescoping member 154 until lower blocks 215 coupled to third telescoping member 156 contact upper blocks 217 coupled to second telescoping member 154. Lower blocks 215 then push upper blocks 217 and second telescoping member 156 upwardly. Second, third, and fourth telescoping members 154, 156, 158 continue to extend upwardly, until lower blocks 215 coupled to second telescoping member 154 contact upper blocks 217 coupled to first telescoping member 152 at which point overall length 163 of support member set 150 becomes fixed.

During retraction of actuator apparatus 56, upper and lower blocks 217, 215 separate as the respective first, second, third, and fourth telescoping members 152, 154, 156, 158 move downwardly relative to one another as shown in FIG. 14. During retraction, lower blocks 217 coupled to third perimeter wall 168 push down on blocks 223 so that second perimeter wall 166 is also pushed down.

Figure 19:
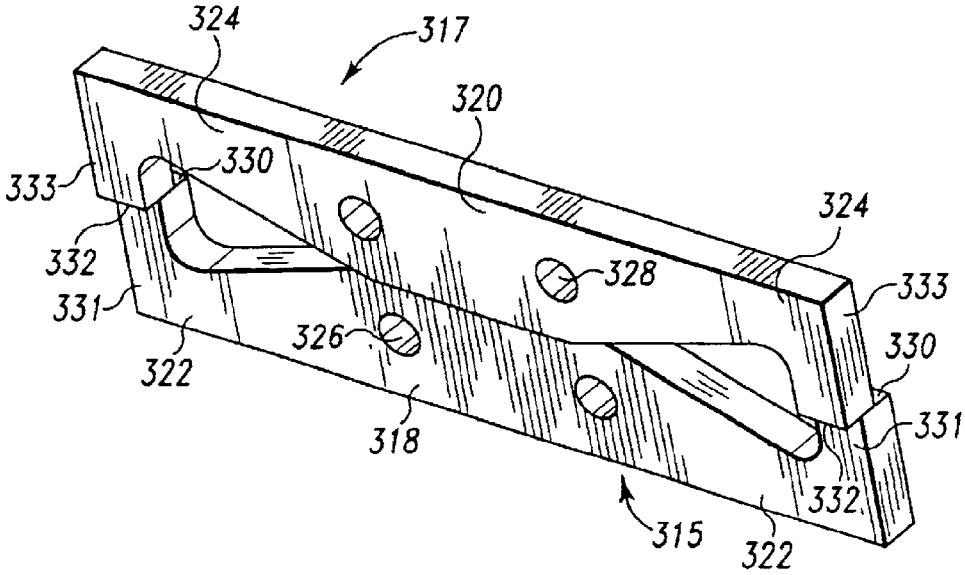
FIG. 19 is a perspective view of a pair of alternative embodiment blocks.
Figure 20:
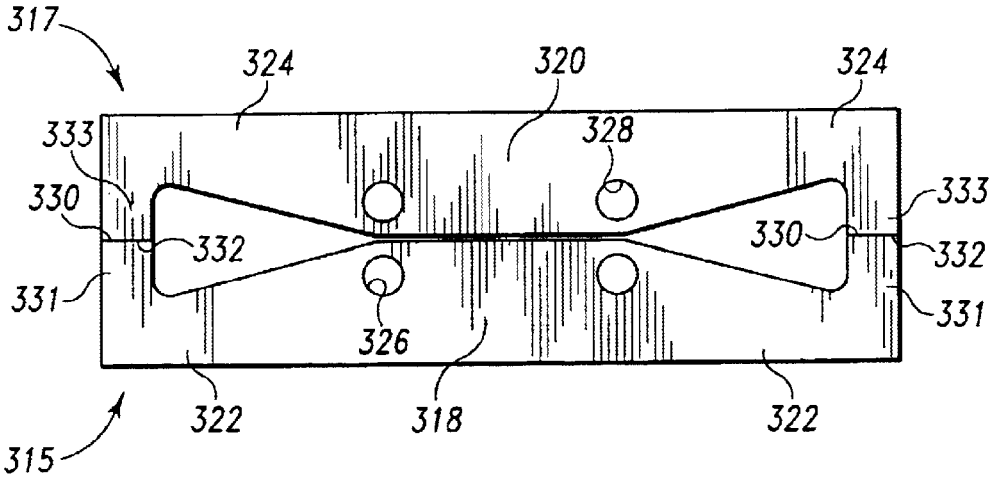
FIG. 20 is a side elevation view of the blocks of FIG. 19.

An alternative pair of respective plate-like lower blocks 315 and plate-like upper blocks 317 are also provided as shown in FIGS. 19 and 20. Lower and upper blocks 315, 317 are coupled to the telescoping members in the same manner as lower and upper blocks 315, 317. Lower and upper blocks 315, 317 include respective bodies 318, 320 and a pair of respective arms 322, 324 coupled to bodies 318, 320. Bodies 318, 320 include apertures 326, 328 sized to receive fasteners 219, 221.

As the actuator apparatus extends, contact surfaces 330 at distal ends 331 of lower blocks 315 approach and push up on contact surfaces 332 at distal ends 333 of upper blocks 317 in a manner similar to lower and upper blocks 215, 217. When lower blocks 315 contact upper blocks 317, contact surfaces 330 of arms 322 push on contact surfaces 332 of arms 324 while bodies 318, 320 remain spaced apart as shown in FIG. 20. The contact causes arms 322, 324 to flex slightly to absorb the impact to provide a spring or shock absorber between the telescoping members during raising of the table top. According to the presently preferred embodiment, lower and upper blocks 315, 317 are made of steel. According to alternative embodiments of the present disclosure, the blocks are made of other materials such as other metals or plastics.

As shown in FIGS. 4–6 and 8–10, first piston rod 88 includes a union or rod end 178 that couples to base 12 and an elongated tube 180 having an interior end 182 that couples to first piston head 86 and an exterior end 184 coupled to rod end 178. Similarly, second piston rod 110 includes a union or rod end 186 coupled to a pair of upwardly extending flanges 188 of yoke 162 and an elongated tube 190 having an interior end 192 coupled to second piston head 98 and an exterior end 194 coupled to rod end 186.

Figure 8:
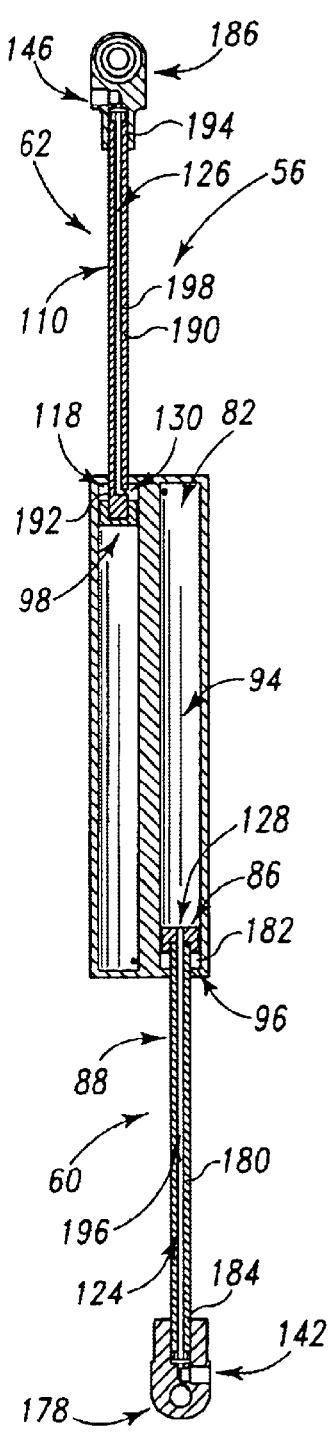
FIG. 8 is a cross-sectional view taken along line 8—8 of FIG. 7 showing the bi-directional hydraulic actuator apparatus including a housing formed to include first and second longitudinally extending piston cylinders, a first downwardly extending piston, and a second upwardly extending piston, the first piston including a first piston head positioned in the first piston cylinder and a first piston rod formed to include a hydraulic fluid passage therein that extends through the first piston head into the first piston cylinder, and the second piston including a second piston head positioned in the second piston cylinder and a second piston rod formed to include a hydraulic fluid passage therein that is in fluid communication with the second piston cylinder adjacent to the second piston head.

As shown in FIG. 8, rod end 178 of first piston rod 88 is formed to include port 142 coupled to first supply line 140. Elongated tube 180 is formed to include a passage 196 extending from exterior end 184 adjacent to port 142 to interior end 184 adjacent to port 128 formed in first piston head 86. Thus, port 142 of rod end 178, passage 196 of elongated tube 180, and port 128 of first piston head 86 cooperate to define first fluid passage 124 communicating fluid from first supply line 140 to first forward chamber 94 of first piston cylinder 82. Rod end 186 of second piston rod 110 is formed to include port 146 coupled to second supply line 144. Elongated tube 190 of second piston rod 110 is formed to include a passage 198 extending from exterior end 194 adjacent to port 146 to interior end 192 adjacent to port 130 formed in elongated tube 190. Thus, port 146 of rod end 186, passage 198 of elongated tube 190, and port 130 of elongated tube 190 cooperate to define second fluid passage 126 communicating fluid from second supply line 144 to second rear chamber 118 of second piston cylinder 84.

Figure 11:
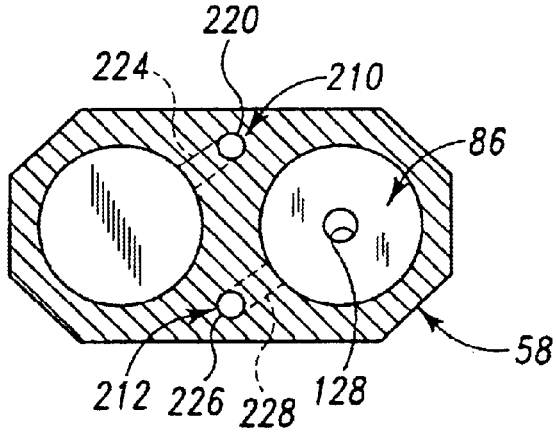
FIG. 11 is a cross-sectional view taken along line 11—11 of FIG. 10 showing the first and second piston cylinders and the first and second hydraulic fluid passages formed in the housing.
Figure 9:
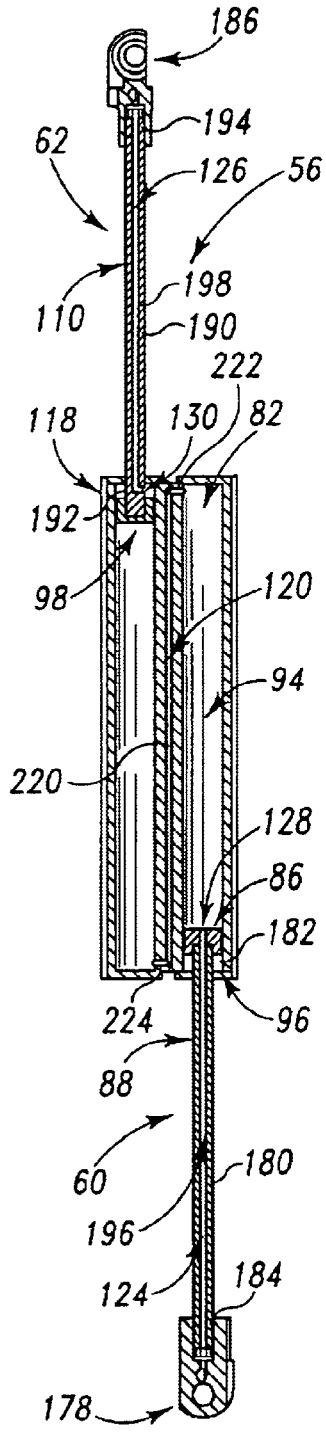
FIG. 9 is a cross-sectional view taken along line 9—9 of FIG. 7 showing the housing being formed to include a first hydraulic fluid passage extending from an upper end of the first piston cylinder to a lower end of the second piston cylinder.
Figure 10:
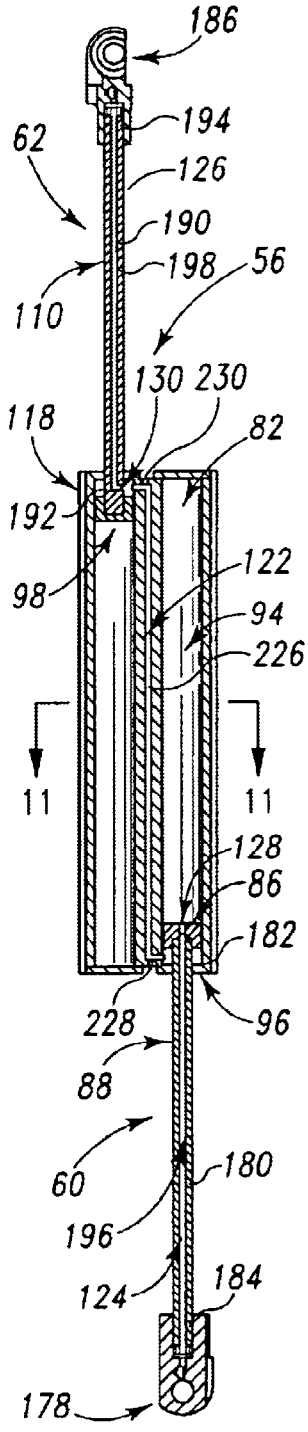
FIG. 10 is a cross-sectional view taken along line 10—10 of FIG. 7 showing the housing being formed to include a second hydraulic fluid passage extending from a lower end of the first piston cylinder to an upper end of the second piston cylinder.

As shown in FIGS. 9–11, housing 58 is formed to include forward chamber fluid passage 120 to communicate fluid between first and second forward chambers 94, 116 and rear chamber fluid passage 122 to communicate fluid between first and second rear chambers 96, 118. Forward chamber fluid passage 120 is formed in a first web 210 of housing 58 and rear chamber fluid passage 122 is formed in a second web 212 of housing 58. First web 210 is formed to include a first axially extending passage 220, an upper port 222 extending from first axially extending passage 220 to first forward chamber 94, and a lower port 224 extending from first axially extending passage 220 to second forward chamber 116. Similarly, second web 212 is formed to include a second axially extending passage 226, a lower port 228 extending from second axially extending passage 226 to first rear chamber 96, and an upper port 230 extending from second axially extending passage 226 to second rear chamber 118. Thus, according to the present disclosure, a preferred embodiment actuator apparatus is provided that has no external fluid passages or supply lines coupled thereto other than the supply lines coupled to the rod end(s). Therefore, the potential of external fluid passages and/or supply lines interfering with or being damaged by external components, such as the telescoping support members, is reduced.

Figure 17:
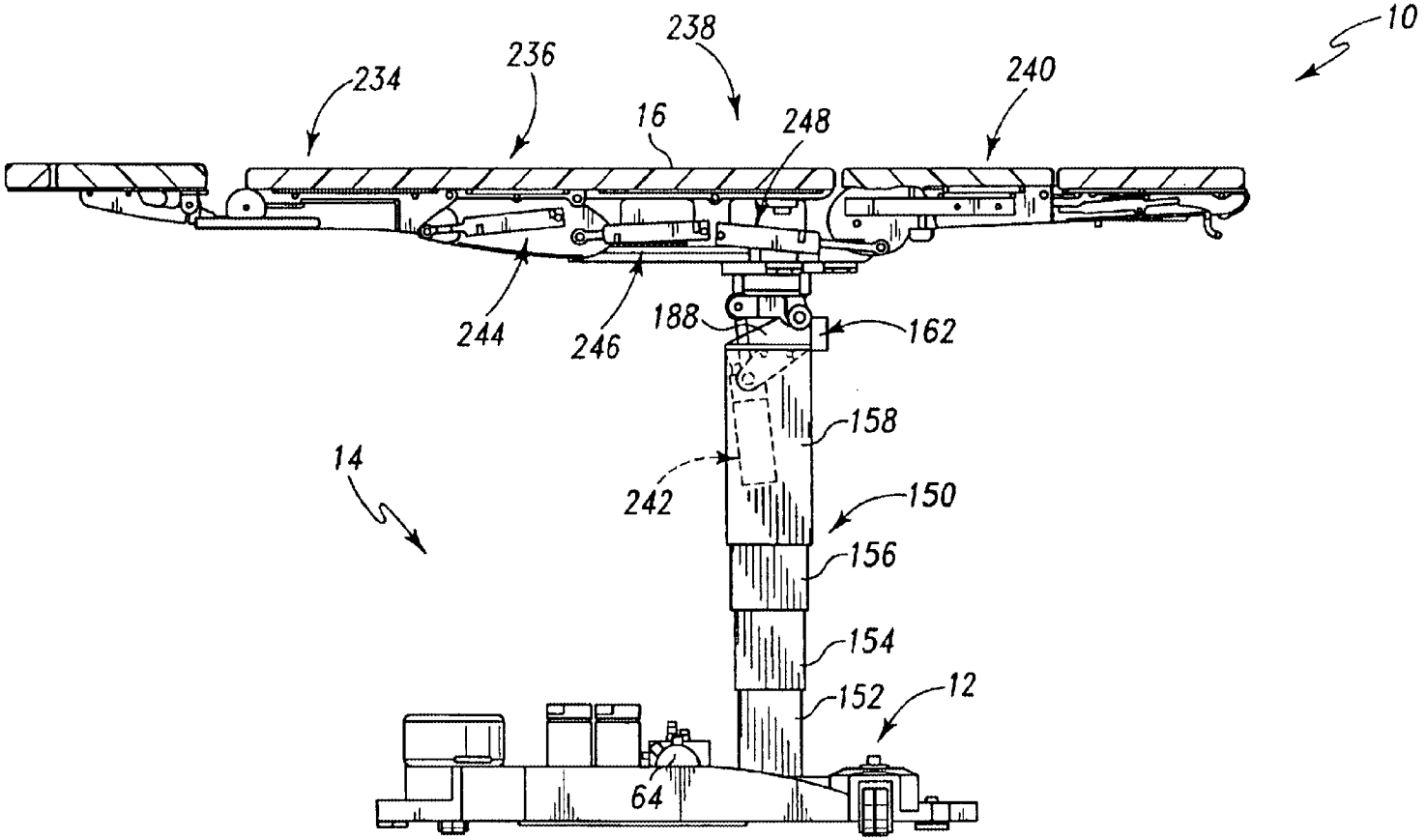
FIG. 17 is a side elevation view of the surgical table of FIG. 1 showing the table top in a substantially planar configuration.
Figure 18:
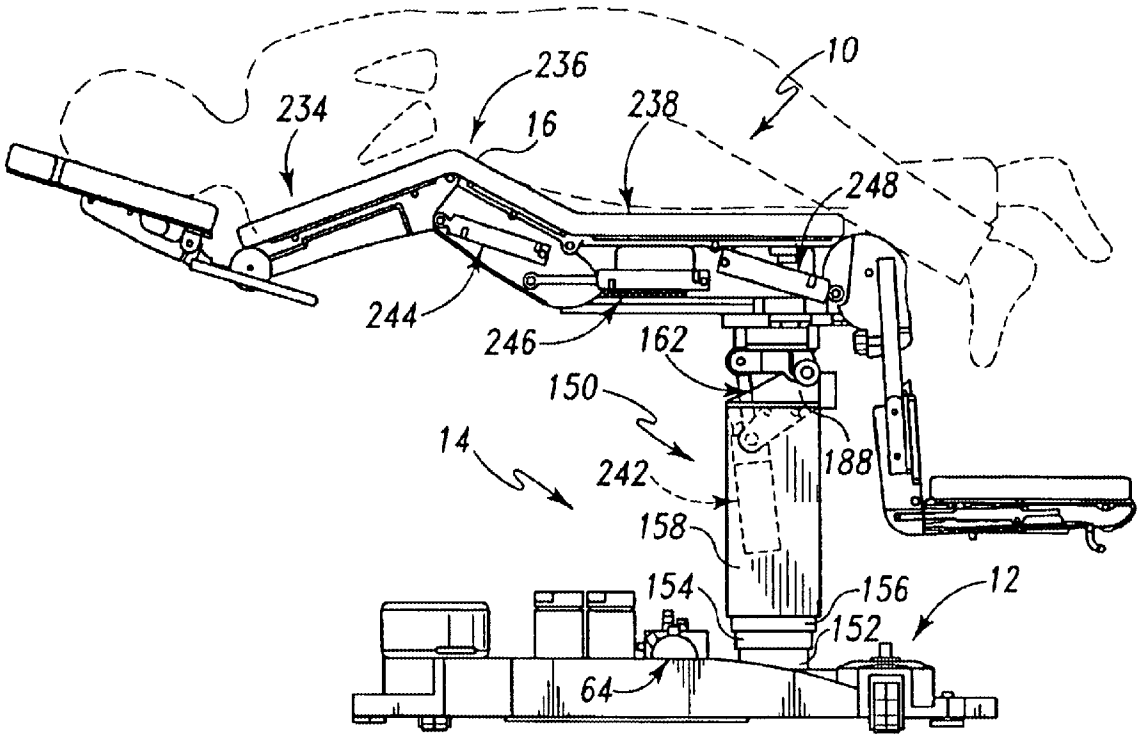
FIG. 18 is a view similar to FIG. 17 showing the table top in a non-coplanar position.

As shown in FIG. 1, first three-position valve 68 is coupled to base 38 and remains stationary therewith during movement of actuator apparatus 56. Fluid system 54 includes a fluid distributor 232 coupled to fourth telescoping support member 158 that raises and lowers therewith during movement of actuator apparatus 56. Fluid distributor 232 includes second three-position valve 70 and other valves (not shown) used to control the position of first, second, third, and fourth sections 234, 236, 238, 240 (as shown in FIGS. 17 and 18) of surgical table top 16 relative to each other and telescoping lift assembly 14 (the fluid lines are not shown in FIGS. 17 and 18 for clarity). For example, table 10 includes a first actuator 242 coupled to yoke 162 and third section 238 of surgical table top 16 to control the angle of inclination of table top 16. Furthermore, table 10 includes second, third, and fourth actuators 244, 246, 248 coupled to respective first and second sections 234, 236, second and third sections 236, 238, and third and fourth sections 238, 240 to control the angular positions of first, second, third, and fourth sections 234, 236, 238, 240 relative to one another as shown in FIGS. 13 and 14.

The additional valves are also coupled to fourth telescoping member 158 and in fluid communication with second pump and tank lines 134, 138 through fluid distributor 232. Thus, fluid distributor 232 provides a manifold in fluid communication with pump 64 and tank 66 that provides power to operate actuators 242, 244, 246, 248 so that pump and tank lines 134, 138 are the only external fluid passages or supply lines that extend along the remainder of telescoping lift assembly 14 and expand and retract during raising and lowering of table top 16. Therefore, the supply lines (not shown) extending from fluid distributor 232 to actuators 242, 244, 246, 248 do not expand or retract with movement of table top 16 between raised and lowered position. According to an alternative embodiment, the second three-position valve is coupled to the base of the table.

To control the position of table top 16 relative to base 12, a surgeon uses an electronic control (not shown) that controls movement of first and second three-position valves 68, 70 to the respective tank and pump positions as mentioned above. Additional electronic controls (not shown) are also provided to control the valves associated with first, second, third, and fourth actuators 242, 244, 246, 248.

Although the invention has been described with reference to preferred embodiments, variations and modifications exist within the scope and spirit of the invention as described and defined in the following claims.

What is claimed is:

1. A patient support comprising a support surface, a base, and a lift assembly positioned to support the support surface above the base, the lift assembly including an actuator configured to adjust the height of the support surface, the actuator including a housing formed to include first and second cylinders, a first piston positioned in the first cylinder, and a second piston positioned in the second cylinder, the first piston including a first piston head and a first piston rod coupled to the first piston head, the first piston rod being formed to include a first fluid passage therein, the second piston including a second piston head and a second piston rod coupled to the second piston head, the second piston rod being formed to include a second fluid passage therein.

2. The patient support of claim 1, wherein the first piston is inverted relative to the second piston.

3. The patient support of claim 1, wherein the first piston acts in series with the second piston.

4. The patient support of claim 1, wherein the first cylinder has a first end and a second end, the second cylinder has a first end and a second end, the first ends of the first and second cylinders are fluidly coupled, and the second ends of the first and second cylinders are fluidly coupled.

5. The patient support of claim 4, wherein a pressure increase in the second ends of the first and second cylinders extends the actuator.

6. The patient support of claim 4, wherein a pressure increase in the first ends of the first and second cylinders retracts the actuator.

7. The patient support of claim 1, wherein the first piston head has a first side and a second side, the second piston head has a first side and a second side, the first fluid passage is configured to be fluidly coupled to the first cylinder on the second side of the first piston head, and the second fluid passage is configured to be fluidly coupled to the second cylinder on the first side of the second piston head.

8. The patient support of claim 7, wherein the first piston rod is connected to the second side of the first piston head and the second piston rod is connected to the second side of the second piston head.

9. The patient support of claim 1, wherein the lift assembly further includes a plurality of telescoping support tubes defining an interior region and the actuator is positioned in the interior region.

10. The patient support of claim 9, wherein the lift assembly further includes a plurality of shock absorbers coupled to the plurality of telescoping tubes, each shock absorber includes a body and a pair of arms coupled to the body such that extension of the lift assembly causes contact between arms of the shock absorbers coupled to adjacent telescoping tubes.

11. The patient support of claim 1, further comprising a fluid system coupled to the first and second pistons to supply pressurized fluid to the housing.

12. A patient support comprising a base, a support surface, a lift assembly including a plurality of telescoping support tubes defining an interior region, and an actuator located in the interior region of the plurality of telescoping support tubes, the actuator including a plurality of pistons, each piston having at least one fluid line positioned therein.

13. The patient support of claim 12, wherein the plurality of pistons includes first and second pistons and the first piston is inverted relative to the second piston.

14. The patient support of claim 12, wherein the plurality of pistons includes first and second pistons and the first piston acts in series with the second piston.

15. The patient support of claim 12, wherein the actuator includes a first cylinder and a second cylinder, the first cylinder has a first end and a second end, the second cylinder has a first end and a second end, the first ends of the first and second cylinders are fluidly coupled, and the second ends of the first and second cylinders are fluidly coupled.

16. The patient support of claim 15, wherein a pressure increase in the second ends of the first and second cylinders extends the actuator.

17. The patient support of claim 15, wherein a pressure increase in the first ends of the first and second cylinders retracts the actuator.

18. The patient support of claim 12, wherein the plurality of pistons includes a first piston and a second piston, the first piston includes a first piston head and a first piston rod, the second piston includes a second piston head and a second piston rod, the first piston head has a first side and a second side, the second piston head has a first side and a second side, the fluid passage in the first piston extends within the first piston rod and first piston head, and the fluid passage in the second piston extends within the second piston rod and stops short of the second piston head.

19. The patient support of claim 12, the lift assembly including shock absorbers coupled to each of the plurality of telescoping support tubes.

20. The patient support of claim 19, wherein each shock absorber includes a body and a pair of arms coupled to the body such that extension of the actuator causes contact between arms of the shock absorbers coupled to different telescoping support tubes.

21. The patient support of claim 12, further comprising a fluid system coupled to the first and second pistons to supply pressurized fluid to the lift assembly.

22. A patient support comprising a base, a support surface, and a lift assembly including a plurality of telescoping support tubes and an actuator positioned in the plurality of telescoping support tubes, the support tubes and the actuator defining an interior region therebetween, and the interior region being devoid of fluid lines.

23. The patient support of claim 22, wherein the actuator includes a housing formed to include first and second cylinders, a first piston positioned in the first cylinder and a second piston positioned in the second cylinder, the first piston includes a first piston head and a first piston rod coupled to the first piston head, the first piston rod includes a first fluid passage therein, and the second piston includes a second piston head and a second piston rod coupled to the second piston head, the second piston rod being formed to include a second fluid passage therein.

24. The patient support of claim 23, wherein the first piston is inverted relative to the second piston.

25. The patient support of claim 23, wherein the first piston acts in series with the second piston.

26. The patient support of claim 23, wherein the first cylinder has a first end and a second end, the second cylinder has a first end and a second end, the first ends of the first and second cylinders are fluidly coupled, and the second ends of the first and second cylinders are fluidly coupled.

27. The patient support of claim 26, wherein a pressure increase in the second ends of the first and second cylinders extends the actuator.

28. The patient support of claim 26, wherein a pressure increase in the first ends of the first and second cylinders retracts the actuator.

29. The patient support of claim 26, wherein the first piston head has a first side and a second side, the second piston head has a first side and a second side, the first fluid passage is fluidly coupled to the first cylinder on the second side of the first piston head, and the second fluid passage is fluidly coupled to the second cylinder on the first side of the second piston head.

30. The patient support of claim 23, wherein the lift assembly further includes a plurality of shock absorbers coupled to each telescoping tube.

31. The patient support of claim 30, wherein each shock absorber includes a body and a pair of arms coupled to the body such that extension of the lift assembly causes contact between shock absorbers of adjacent telescoping tubes, and the contact is performed by the arms of the absorbers.

32. The patient support of claim 23, further comprising a fluid system coupled to the first and second pistons to supply pressurized fluid to the housing.

33. A patient support comprising a support surface, a base, a lift assembly positioned between the support surface and the base to raise and lower the support surface relative to the base, and a plurality of telescoping support tubes, the support tubes including telescoping support members and shock absorbers configured to dampen impact between the telescoping support members.

34. The patient support of claim 33, wherein each shock absorber includes a body and a pair of arms coupled to the body such that extension of the lift assembly causes contact between the arms of the shock absorbers coupled to adjacent tubes.

35. The patient support of claim 34, wherein the arms of the shock absorbers are flexible.

36. The patient support of claim 33, wherein relative movement between a first telescoping tube and a second telescoping tube causes a first shock absorber coupled to the first telescoping tube to contact a second shock absorber coupled to the second telescoping tube.

37. The patient support of claim 36, wherein extension of the lift assembly raises the first telescoping tube and causes the first shock absorber to contact the second shock absorber.

38. The patient support of claim 37, wherein further extension of the lift assembly raises the second telescoping tube.

39. The patient support of claim 33, wherein the shock absorbers are positioned in spaces between adjacent telescoping support tubes.

40. The patient support of claim 33, wherein the shock absorbers are coupled to one of the telescoping tubes so as to be positioned between the ends of the telescoping tube to which it is attached.

41. The patient support of claim 33, further comprising contact pads positioned to in space between adjacent telescoping support tubes.

42. The patient support of claim 41, wherein the contact pads are positioned in space between adjacent telescoping support tubes with the shock absorbers.

43. The patient support of claim 33, further comprising a fluid system coupled to the first and second pistons to supply pressurized fluid to the lift assembly.

44. An actuator comprising a housing formed to include first and second cylinders, a first piston positioned in the first cylinder, the first piston including a first piston head and a first piston rod coupled to the first piston head, the first piston rod being formed to include a first fluid passage therein such that providing fluid to the housing through the first fluid passage lengthens the actuator, and a second piston positioned in the second cylinder, the second piston including a second piston head and a second piston rod coupled to the second piston head, the second piston rod being formed to include a second fluid passage therein.

45. The actuator of claim 44, wherein the first piston is inverted relative to the second piston.

46. The actuator of claim 44, wherein the first piston acts in series with the second piston.

47. The actuator of claim 44, wherein the first cylinder has a first end and a second end, the second cylinder has a first end and a second end, the first ends of the first and second cylinders are fluidly coupled, and the second ends of the first and second cylinders are fluidly coupled.

48. The actuator of claim 47, wherein a pressure increase in the second ends of the first and second cylinders extends the actuator.

49. The actuator of claim 47, wherein a pressure increase in the first ends of the first and second cylinders retracts the actuator.

50. The actuator of claim 47, wherein the first piston head has a first side and a second side, the second piston head has a first side and a second side, the first fluid passage is configured to be fluidly coupled to the first cylinder on the second side of the first piston head, and the second fluid passage is configured to be fluidly coupled to the second cylinder on the first side of the second piston head.

51. The actuator of claim 50, wherein the first piston rod is coupled to the second side of the first piston head and the second piston rod is coupled to the second side of the second piston head.

52. The actuator of claim 44, further comprising a fluid system coupled to the first and second pistons to supply pressurized fluid to the housing.

53. The actuator of claim 44, wherein providing fluid to the housing through the second fluid passage shortens the actuator.

54. An actuator comprising a housing, a first piston positioned in the housing, a second piston positioned in the housing, and a fluid system coupled to each of the first and second pistons to supply pressurized fluid to the housing, the first piston including a first piston head and a first piston rod coupled to the piston head, the first piston rod includes a first fluid passage therein in fluid communication with the fluid system, the second piston includes a second piston head and a second piston rod coupled to the piston head, and the second piston rod includes a second fluid passage therein in fluid communication with the fluid system, fluid flow into the housing through the first fluid passage causing expansion of the first and second pistons and fluid flow into the housing through the second fluid passage causing contraction of the first and second pistons.

55. The actuator of claim 54, wherein the first piston head cooperates with the housing to define a first cavity and a second cavity, the first piston head is positioned between the first and second cavities, the second piston head cooperates with the housing to define a third cavity and a fourth cavity, and the second piston head is positioned between the third and fourth cavities.

56. The actuator of claim 55, wherein the first cavity is fluidly coupled to the third cavity and the second cavity is fluidly coupled to the fourth cavity.

57. The actuator of claim 55, wherein a pressure increase in the first and third cavities extends the actuator.

58. The actuator of claim 55, wherein a pressure increase in the second and fourth cavities retracts the actuator.

59. The actuator of claim 55, wherein the first fluid passage is in fluid communication with the first cavity.

60. The actuator of claim 55, wherein the second fluid passage is in fluid communication with the fourth cavity.

61. An actuator comprising a housing, a first piston positioned in the housing, a second piston positioned in the housing, and a fluid system coupled to each of the first and second pistons to supply pressurized fluid to the housing, the first piston acting in series with the second piston to extend and retract the actuator, fluid flow into the housing through a first fluid passage within the first piston causing expansion of the first and second pistons and fluid flow into the housing through a second fluid passage within the second piston causing contraction of the first and second pistons.

62. An actuator comprising a housing, a first piston positioned in the housing, a second piston positioned in the housing, and means for providing pressurized fluid to the housing, the pressurized fluid providing means including a fluid passage in each of the first and second pistons, fluid flow in the fluid passage of the first piston causing fluid flow in the fluid passage of the second piston.

63. The actuator of claim 62, wherein each piston includes a piston head and a piston rod coupled to the piston head, the fluid passage in the first piston extends in the piston rod and head of the first piston, and the fluid passage in the second piston extends in the piston rod of the second piston and stops short of the piston head of the second piston.

64. The actuator of claim 62, wherein the first piston acts in series with the second piston.

65. The actuator of claim 64, wherein the first piston includes a first piston head and a first piston rod coupled to the first piston head, the first piston rod includes a first fluid passage therein, the second piston includes a second piston head and a second piston rod coupled to the second piston head, and the second piston rod includes a second fluid passage therein.

66. The actuator of claim 65, wherein the first piston head cooperates with the housing to define a first cavity and a second cavity and the second piston head cooperates with the housing to define a third cavity and a fourth cavity.

67. The actuator of claim 66, wherein the first cavity is fluidly coupled to the third cavity and the second cavity is fluidly coupled to the fourth cavity.

68. The actuator of claim 66, wherein a pressure increase in the first and third cavities extends the actuator.

69. The actuator of claim 66, wherein a pressure increase in the second and fourth cavities retracts the actuator.

70. The actuator of claim 66, wherein the first fluid passage is in fluid communication with the first cavity.

71. The actuator of claim 66, wherein the second fluid passage is in fluid communication with the fourth cavity.

72. An actuator comprising a housing, a first piston positioned in the housing, a second piston positioned in the housing, a first fluid passage positioned in the first piston, a second fluid passage positioned in the second piston, and a fluid system coupled to the first and second passages to provide pressurized fluid thereto to retract and extend the first and second pistons, fluid provided to the housing via the first fluid passage causing expansion of both the first and second pistons, and fluid provided to the housing via the second fluid passage causing contraction of both the first and second pistons.

73. The actuator of claim 72, wherein the first piston is inverted relative to the second piston.

74. The actuator of claim 72, wherein the first piston acts in series with the second piston.

75. The actuator of claim 72, wherein the first piston includes a first piston head and a first piston rod coupled to the first piston head, the first piston rod includes the first fluid passage therein, and the second piston includes a second piston head and a second piston rod coupled to the second piston head, the second piston rod includes the second fluid passage therein.

76. The actuator of claim 75, wherein the first piston head cooperates with the housing to define a first cavity and a second cavity and the second piston head cooperates with the housing to define a third cavity and a fourth cavity.

77. The actuator of claim 76, wherein the first cavity is fluidly coupled to the third cavity and the second cavity is fluidly coupled to the fourth cavity.

78. The actuator of claim 76, wherein a pressure increase in the first and third cavities extends the actuator.

79. The actuator of claim 76, wherein a pressure increase in the second and fourth cavities retracts the actuator.

80. The actuator of claim 76, wherein the first fluid passage is fluidly coupled to the first cavity and the second fluid passage is fluidly coupled to the fourth cavity.

* * * * *